US005288275A

United States Patent [19]

St. Peter

[11] Patent Number: 5,288,275

[45] Date of Patent: Feb. 22, 1994

[54] PIVOTING TARGET BOWLING TRAINING APPARATUS

[76] Inventor: Gail D. St. Peter, 701 Jefferson St., Scranton, Iowa 51462

[21] Appl. No.: 17,606

[22] Filed: Feb. 16, 1993

[51] Int. Cl.[5] ..... A63D 5/04

[52] U.S. Cl. ..... 473/58; 273/390; 273/127 D; 473/75

[58] Field of Search ..... 273/176 B, 177 A, 181 R, 273/181 J, 184 R, 54 R, 54 D, 63 D, 352, 375, 390, 127 D; 254/29 R, 30, 29 A; 135/108, 75

[56] References Cited

U.S. PATENT DOCUMENTS 1,650,029 11/1927 Morton ..... 273/127 D
2,206,318 7/1940 Comoletti ..... 273/375
3,094,330 6/1963 Smith ..... 273/54 D
3,105,685 10/1963 Jahn ..... 273/54 D
3,473,804 10/1969 Pecora ..... 273/54 D
3,690,664 9/1972 Hauke ..... 273/127 D
3,899,170 8/1975 Parks ..... 273/127 D X

*Primary Examiner*—Vincent Millin
*Assistant Examiner*—William M. Pierce
*Attorney, Agent, or Firm*—Leon Gilden

[57] ABSTRACT

A support shaft arranged in a spaced relationship relative to a bowling lane top surface is arranged to include slidably mounted signal members, wherein the signal members are arranged for rotary displacement upon communication of a bowling ball with a flange portion of each signal member. Indication of bowling ball path to provide for training and correction of such path is thereby enabled.

1 Claim, 4 Drawing Sheets

PIVOTING TARGET BOWLING TRAINING APPARATUS

BACKGROUND OF THE INVENTION

1. Field of the Invention

The field of invention relates to bowling training structure, and more particularly pertains to a new and improved bowling training apparatus wherein the same is arranged to indicate path of a bowling ball relative to its trajectory along a bowling lane.

2. Description of the Prior Art

Bowling training structure such as indicated in U.S. Pat. No. 4,822,040 are available in the prior art to indicate trajectory path of a bowling ball, wherein the U.S. Pat. No. 4,822,040 includes a target sheet arranged for positioning upon a bowling lane to indicate path of the bowling ball as it is directed over the sheet.

The instant invention attempts to overcome deficiencies of the prior art by providing for a readily positioned and mounted apparatus, wherein the same is arranged to permit immediate visual indication in the deflection of signal members displaced upon a bowling ball effecting contact with the signal members and in this respect, the present invention substantially fulfills this need.

SUMMARY OF THE INVENTION

In view of the foregoing disadvantages inherent in the known types of bowling apparatus now present in the prior art, the present invention provides a bowling training apparatus wherein the same is arranged to include a signal structure arranged for retrofit relative to an existing bowling lane to indicate passage of a bowling ball within the signal structure of the invention. As such, the general purpose of the present invention, which will be described subsequently in greater detail, is to provide a new and improved bowling training apparatus which has all the advantages of the prior art bowling apparatus and none of the disadvantages.

To attain this, the present invention provides a support shaft arranged in a spaced relationship relative to a bowling lane top surface, to include slidably mounted signal members, wherein the signal members are arranged for rotary displacement upon communication of a bowling ball with a flange portion of each signal member. Indication of bowling ball path to provide for training and correction of such path is thereby enabled.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bowling training apparatus which has all the advantages of the prior art bowling apparatus and none of the disadvantages.

It is another object of the present invention to provide a new and improved bowling training apparatus which may be easily and efficiently manufactured and marketed.

It is a further object of the present invention to provide a new and improved bowling training apparatus which is of a durable and reliable construction.

An even further object of the present invention is to provide a new and improved bowling training apparatus which is susceptible of a low cost of manufacture with regard to both materials and labor, and which accordingly is then susceptible of low prices of sale to the consuming public, thereby making such bowling training apparatus economically available to the buying public.

Still yet another object of the present invention is to provide a new and improved bowling training apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
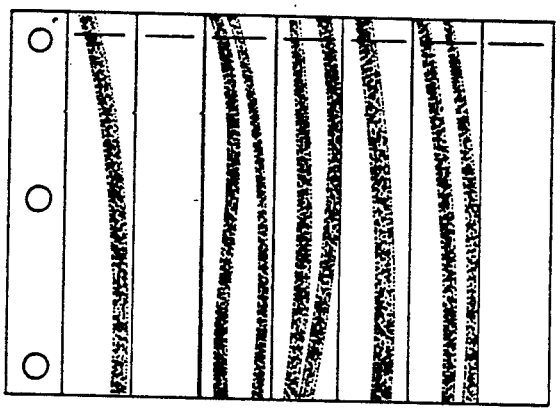
FIG. 1 is an orthographic view of the indicator sheet structure indicating bowling paths thereon of a bowling ball, such as set forth in U.S. Pat. No. 4,822,040.

With reference now to the drawings, and in particular to FIGS. 1 to 9 thereof, a new and improved bowling training apparatus embodying the principles and concepts of the present invention and generally designated by the reference numeral 10 will be described.

Figure 2:
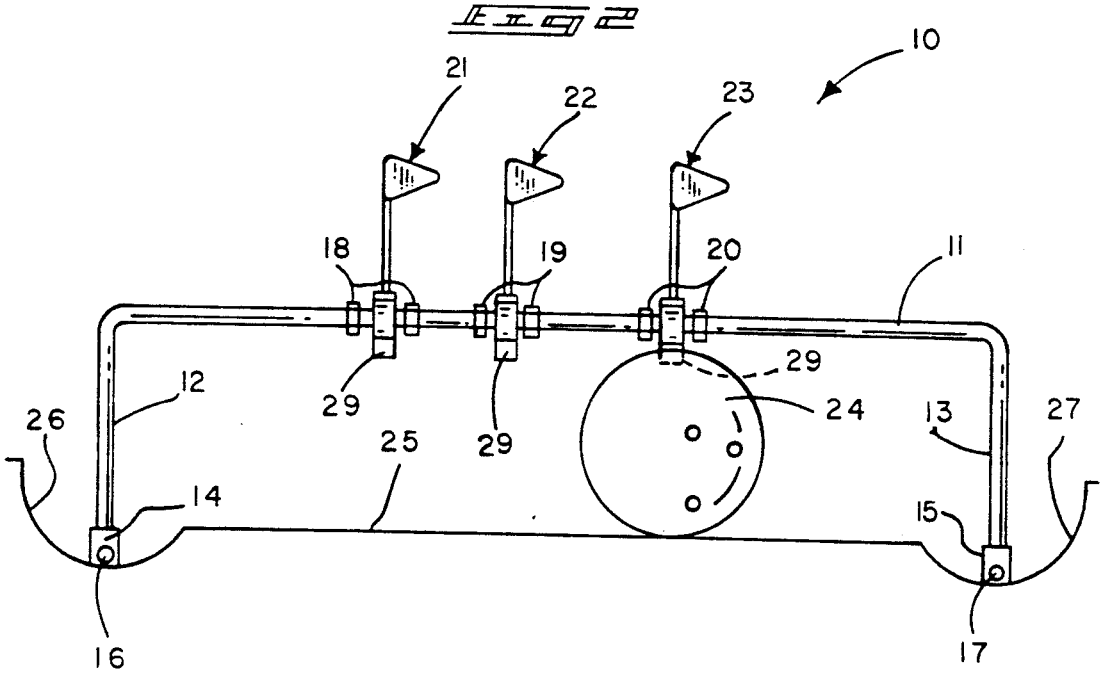
PRIOR ART FIG 2
FIG. 2 is an orthographic view of the invention mounted to a bowling lane.
Figure 3:
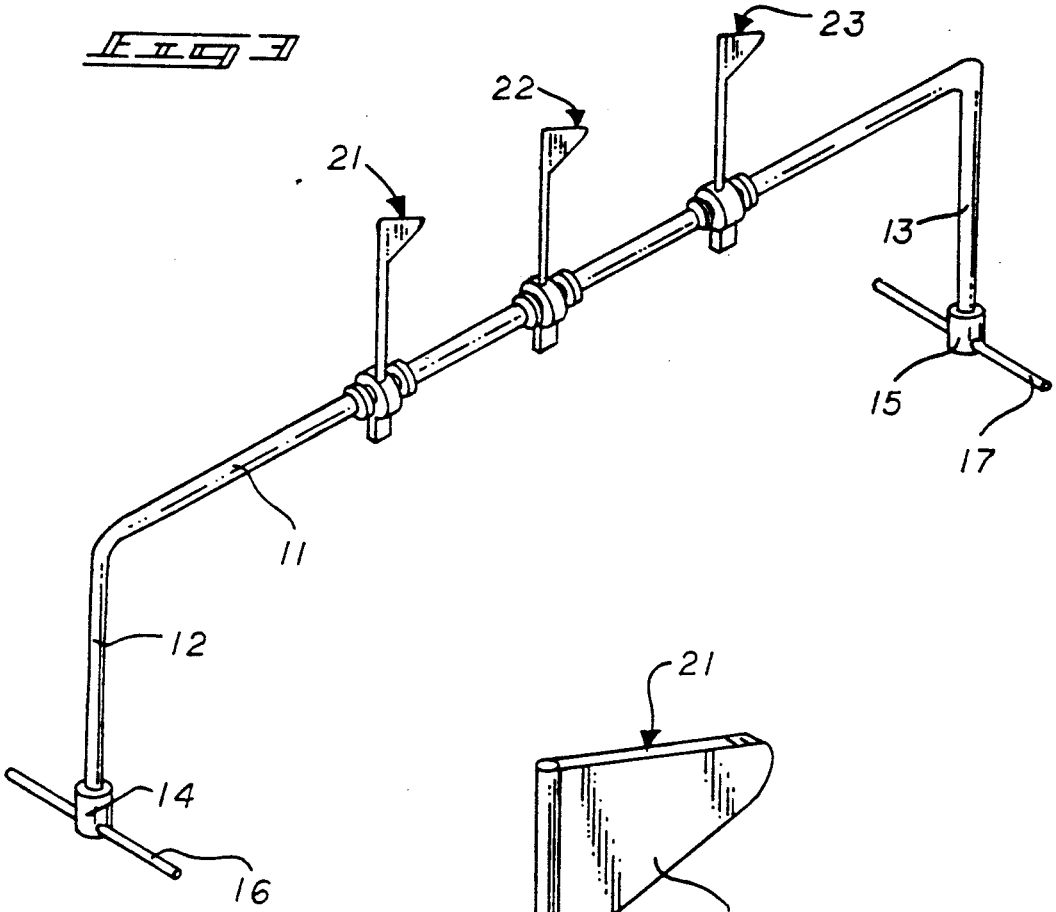
FIG. 3 is an isometric illustration of the invention.
Figure 4:
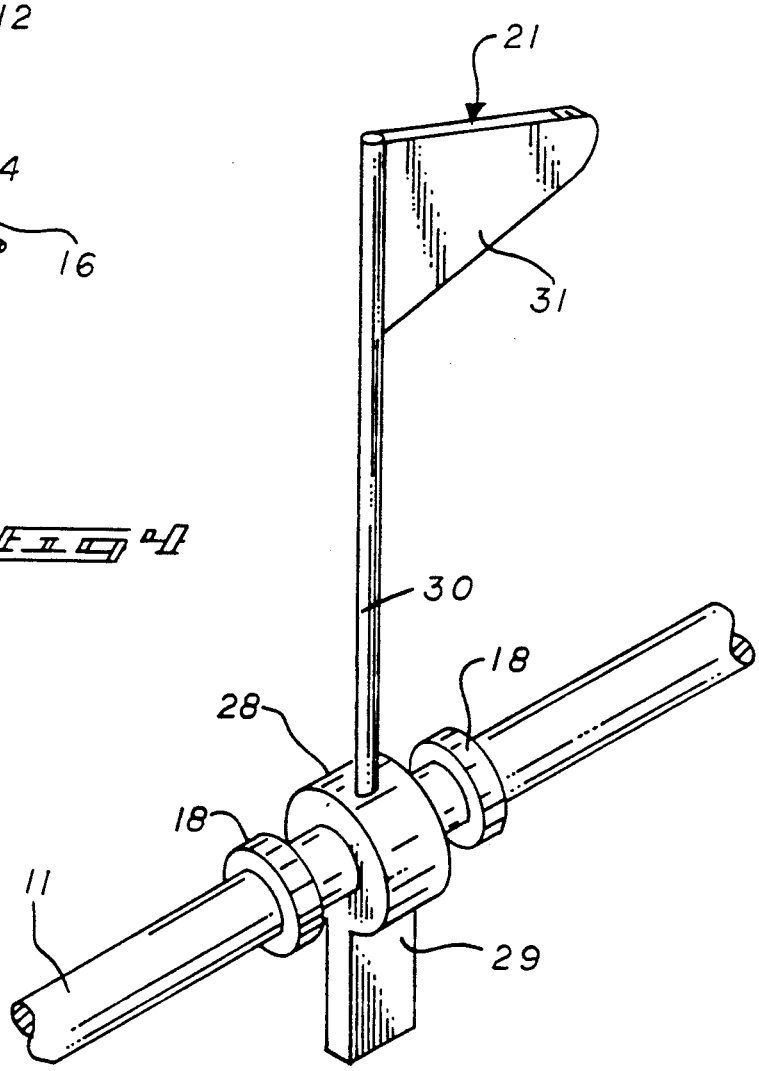
FIG. 4 is an enlarged isometric illustration of one of the signal members employed by the invention.

More specifically, the bowling training apparatus 10 of the instant invention essentially comprises a support shaft 11, having respective first and second support legs 12 and 13 orthogonally and integrally mounted to the support shaft 11 at opposed ends of the support shaft, wherein the first and second support legs 12 and 13 are arranged in a coextensive and parallel relationship relative to one another. The first support leg 12 includes a first support head at the free distal end of the first support leg, with the second support leg having a second support head 15 at a free distal end of the second support leg, with the first head 14 having a first head support shaft 16 orthogonally mounted fixedly to the first head 14 in an orthogonal relationship relative to the first support leg 12. The second head 15 has a second head support shaft 17 integrally mounted to the second head in an orthogonal relationship relative to the second support leg 13, wherein the first and second head support shafts 16 and 17 are mounted within respective first and second gutter channels 26 and 27 of a bowling lane 25 as the support shaft 11 spans the bowling lane between the gutter channels 26 and 27, as indicated in FIG. 2. Respective first, second, and third signal members 21, 22, and 23 respectively are slidably mounted along the support shaft 11 in a rotatable relationship, to be discussed in more detail below, with respective first, second, and third resilient ring pairs 18, 19, and 20 mounted to opposed sides of the respective first, second, and third signal members 21, 22, and 23 to effect selective positioning of the signal members along the support shaft 11. In this manner, the resilient ring pairs may be longitudinally displaced along the support shaft 11 to position a respective signal member therebetween to provide for a target orientation of the signal members relative to the bowling lane as the bowling ball 24 passes below the support shaft 11. As the bowling ball 24 effects contact with one of the signal members 21–23, the signal members are rotatably displaced along the support shaft 11 for visual indication of positioning of the bowling ball relative to the bowling lane, as indicated. Each of the signal members 21–23 includes a rotary hub 28 rotatably mounted to the support shaft 11, with the rotary hub 28 having a hub flange 29 and a shaft 30,. wherein the flange and shaft are diametrically aligned relative to one another on opposed sides of an associated rotary hub 28. In this manner, the rotary hub 29 is spaced from the bowling lane 25 a predetermined spacing that is less than the predetermined diameter defined by the bowling ball 24 to effect contact with a bowling ball relative to the flange 29 to effect rotary displacement of an associated signal member, as indicated in FIG. 2.

Figure 5:
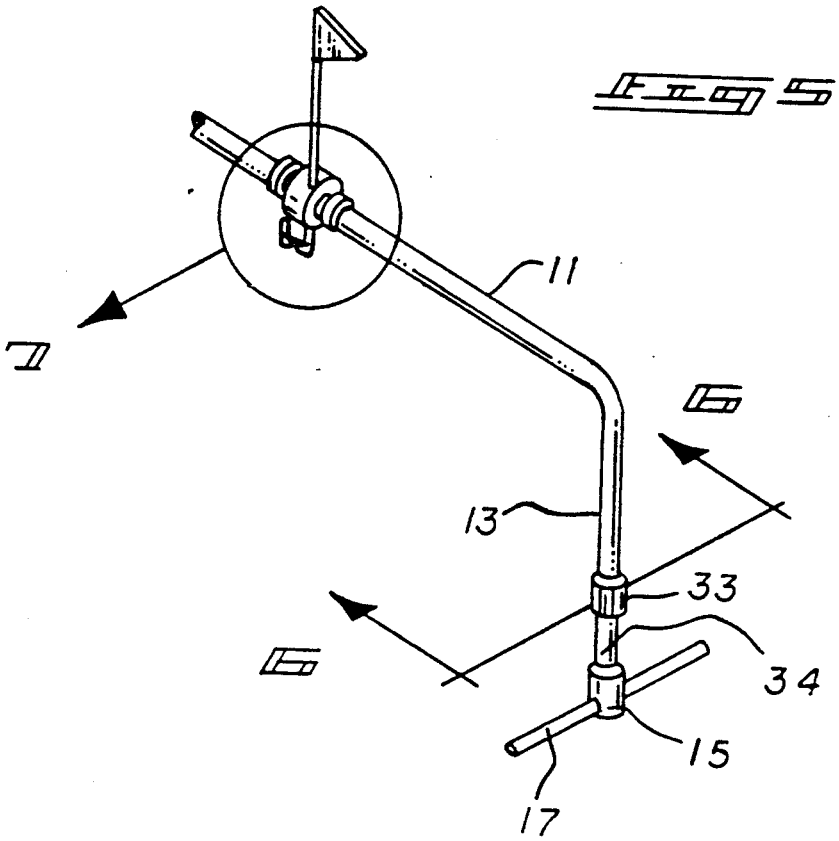
FIG. 5 is an isometric illustration of a modified support structure for the support legs of the invention.
Figure 6:
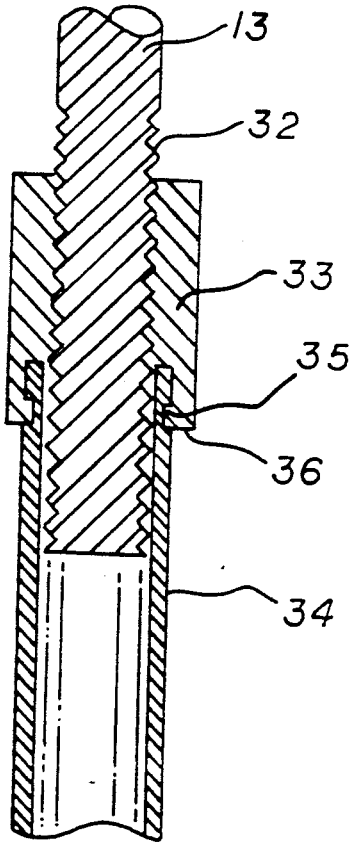
FIG. 6 is an enlarged orthographic view, taken along the lines 6—6 of FIG. 5 in the direction indicated by the arrows.
Figure 7:
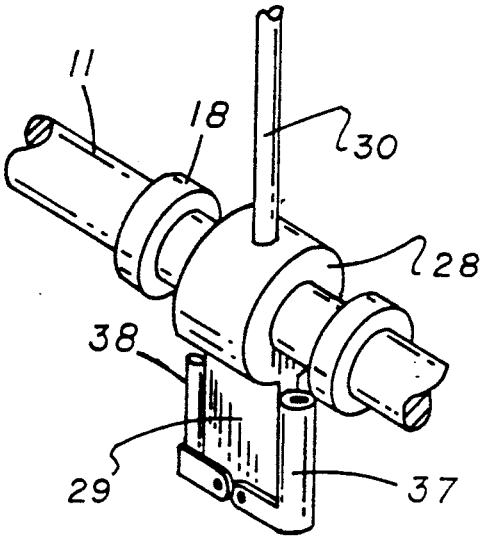
FIG. 7 is an enlarged isometric illustration of section 7 as set forth in FIG. 5.
Figure 8:
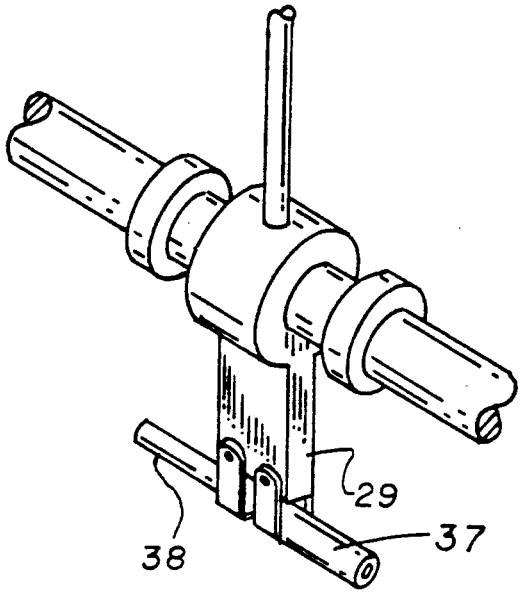
FIG. 8 is an isometric illustration of the connecting structure, as indicated in FIG. 7.

With reference to FIGS. 5 and 6 indicates that each of the support legs 12 and 13 (for purposes of illustration only the second support leg 13 is described, but it should be understood that they are to be of identical construction), wherein each support leg includes a leg externally threaded end portion 32 threadedly receiving an internally threaded locking collar 33 that includes a collar annular flange 36. The collar annular flange 36 is arranged to be received within an annular groove 35 of an extension shank 34 that is coaxially aligned with the locking collar 33 and the leg 13, with the free distal end of the extension shank 34 having mounted thereon the associated second head 15. In this manner, height adjustment of the support shaft 11 is provided to accommodate varying heights of an associated gutter relative to a bowling lane 25.

Figure 9:
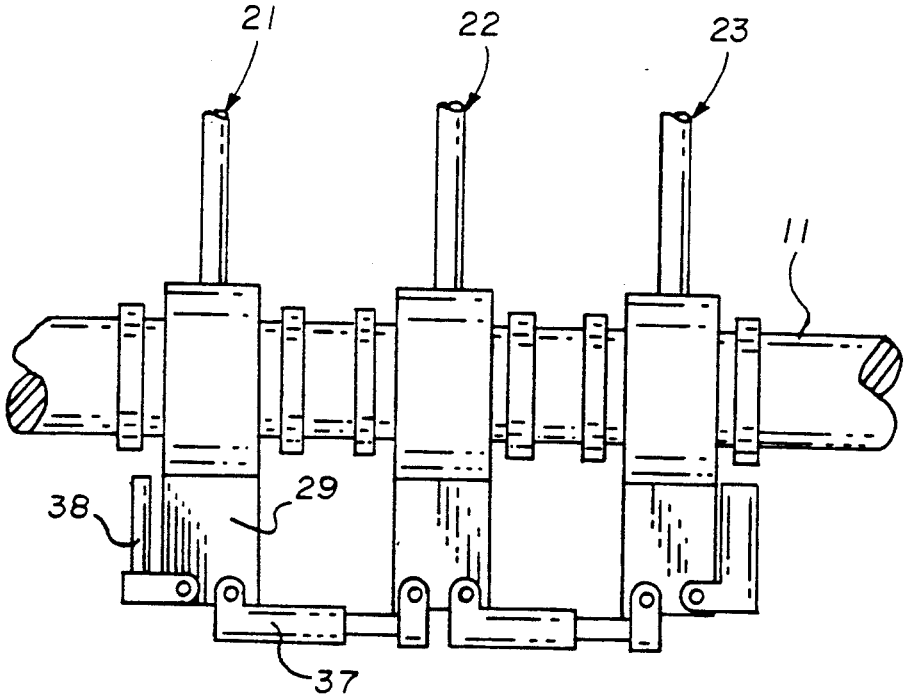
FIG. 9 is an orthographic view of the connecting structure arranged in intercommunication relative to the various signal members mounted to the support shaft of the invention.

The FIGS. 5 and 7 through 9 further indicate that each of the signal members may be arranged for interlocking relative to one another to provide for a greater target area relative to the bowling ball 24. To this end, each flange 29 includes a locking tube 37 and a locking rod 38, each pivotally mounted relative to the flange 29. A locking tube 37 is arranged to receive a locking rod 38 of an adjacent signal member 29 and in this manner, such as indicated in FIG. 9, provide for interlocking of a plurality or all of the signal members as desired to provide for the greater target area of the bowling ball as it passes beneath the support shaft 11.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bowling training apparatus arranged in combination with a bowling lane, wherein the bowling lane includes a lane top surface and a first gutter channel and a second gutter channel mounted in communication with a bowling lane on opposed sides of the bowling lane, and a support shaft, the support shaft arranged parallel to the bowling lane, and the support shaft having a first support leg for reception with the first gutter channel and a second support leg received within the second gutter channel, wherein the first support leg and the second support leg are arranged in a parallel relationship relative to one another and orthogonally mounted to the support shaft, and a plurality of signal members, including a first signal member and a second signal member, wherein the first signal member is arranged for rotative mounting relative to the support shaft, and second signal member arranged for rotative mounting to the support shaft, and the first signal member includes a first resilient ring pair mounted on opposed sides of the signal member resiliently engaging the support shaft, and the second signal member including a second resilient ring pair, to include a second resilient ring mounted on opposed sides of the second signal member frictionally engaging the support shaft, and the first signal member includes a first rotary hub and a first flange mounted to the rotary hub oriented between the rotary hub and the bowling lane, and a first shaft mounted to the rotary hub diametrically aligned with the first flange, and the first flange having a first indicator flag thereon, and the second signal member including a second rotary hub, wherein the second rotary hub includes a second flange and a second shaft, the second flange and the second shaft arranged in a diametrically aligned relationship relative to the second rotary hub on opposed sides of the second rotary hub, and the second shaft having a second flag member mounted to the second shaft, and the first support leg and the second support leg each include an externally threaded end portion, and each externally threaded end portion includes an internally threaded locking collar, and each locking collar includes an annular flange, and each locking collar includes an extension shank coaxially aligned with the locking collar and the externally threaded end portion, and the extension shank including a shank annular groove to receive the annular flange, and each extension shank includes a head member, and each head member includes a support shaft directed through the head member orthogonally oriented relative to said extension shank, and the first flange includes a first locking tube and a first locking rod pivotally mounted to the first flange, and the second flange includes a second locking tube and a second lock rod, wherein the first locking tube is arranged to receive the second locking rod therewithin to secure the first signal member to the second signal member.

* * * * *